United States Patent [19]

Saito et al.

[11] Patent Number: 4,688,032

[45] Date of Patent: Aug. 18, 1987

[54] IMAGE DISPLAY CONTROL APPARATUS

[75] Inventors: Mitsuo Saito, Yokosuka; Takeshi Aikawa, Kawasaki; Akio Mori, Tokyo, all of Japan

[73] Assignee: Tokyo Shibaura Denki Kabushiki Kaisha, Kawasaki, Japan

[21] Appl. No.: 879,539

[22] Filed: Jun. 24, 1986

Related U.S. Application Data

[63] Continuation of Ser. No. 508,039, Jun. 27, 1983, abandoned.

[30] Foreign Application Priority Data

Jun. 28, 1982 [JP] Japan ..... 57-111213
Jun. 28, 1982 [JP] Japan ..... 57-111226

[51] Int. Cl.[4] ..... G09G 1/16

[52] U.S. Cl. ..... 340/799; 340/723; 340/724; 340/798

[58] Field of Search ..... 340/721, 703, 723, 724, 340/726, 780, 798, 799

[56] References Cited

U.S. PATENT DOCUMENTS 4,070,710 1/1978 Sukonick et al. ..... 340/721
4,103,331 7/1978 Thacker ..... 340/750
4,180,805 12/1979 Burson ..... 340/724
4,200,867 4/1980 Hill ..... 340/724
4,203,107 5/1980 Lovercheck ..... 340/799
4,236,228 11/1980 Nagashima et al. ..... 340/799
4,439,761 3/1984 Fleming et al. ..... 340/799
4,454,593 6/1984 Fleming et al. ..... 340/723
4,533,910 8/1985 Sukonick et al. ..... 340/798

OTHER PUBLICATIONS

"An Image/Text Inputting and Outputting System for Mainly Effecting Image Display", Information Processing Society (1980), A Preprint of the 21st National Meeting (P1129).

*Primary Examiner*—Gerald L. Brigance
*Attorney, Agent, or Firm*—Oblon, Fisher, Spivak, McClelland, & Maier

[57] ABSTRACT

Document image data stored in an image memory with a large memory capacity capable of storing larger data than the number of picture elements of a display unit is accessed and read out by using a mapping memory which stores the address data to specify the memory locations of picture element data groups in the image memory. The document image data read out are edited, and then are seen as document images by the display unit.

9 Claims, 21 Drawing Figures

FIG. 5
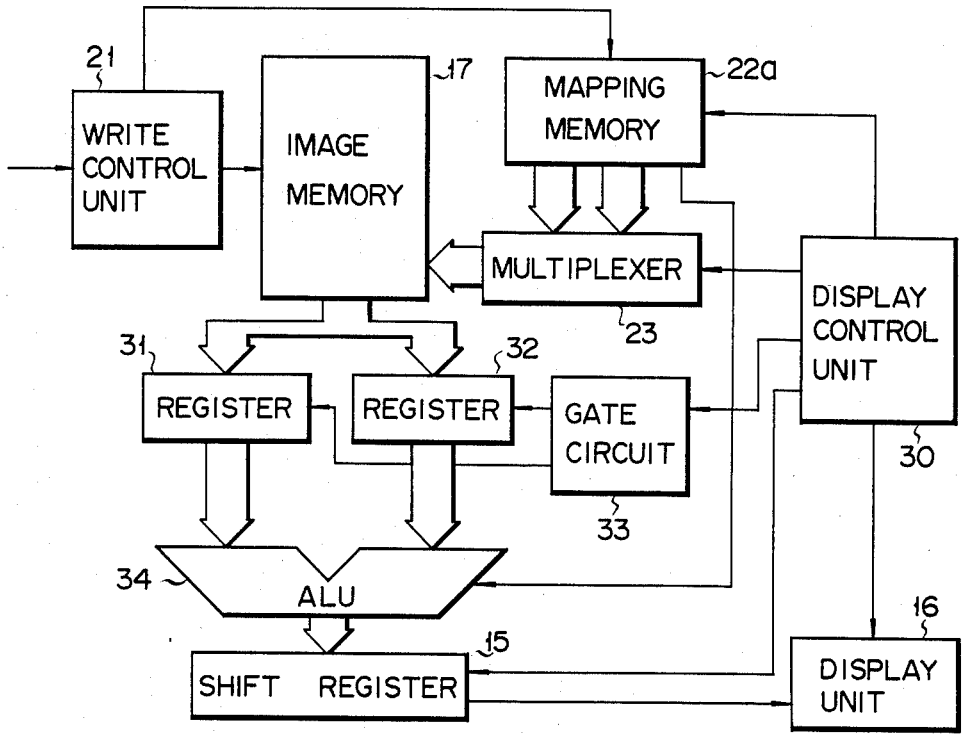
FIG. 6
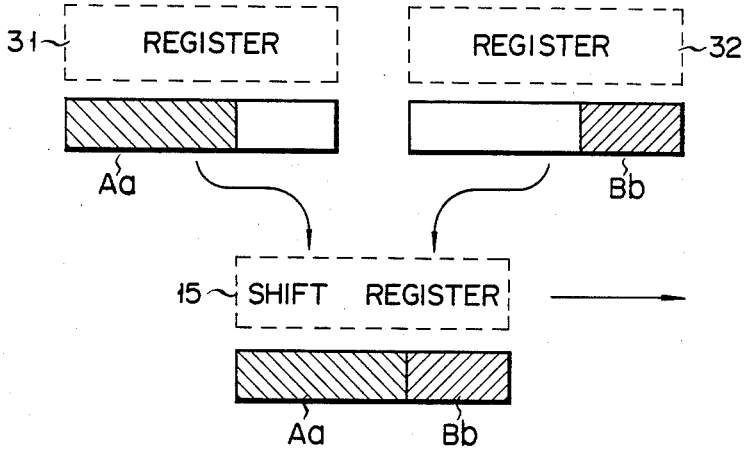
FIG. 7
| AD 1 | AD 2 | MSK 1 | MSK2 | OP. |
|---|---|---|---|---|

FIG. 14A
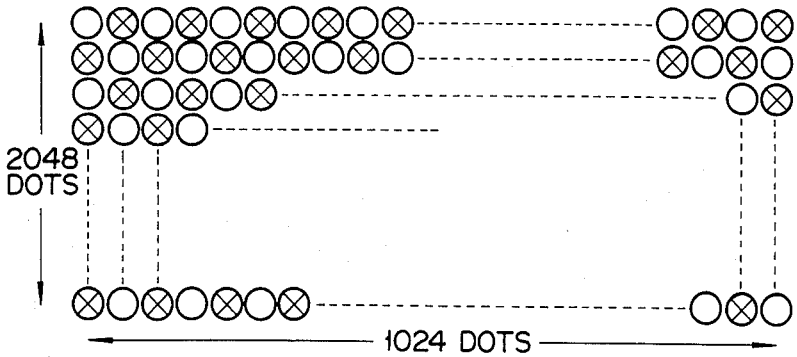
FIG. 14B
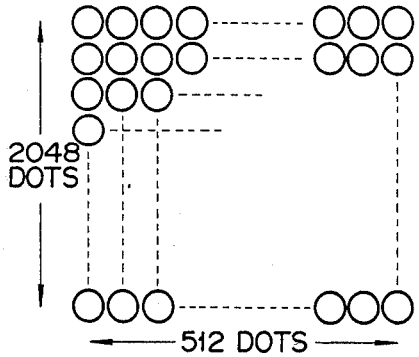
FIG. 14C
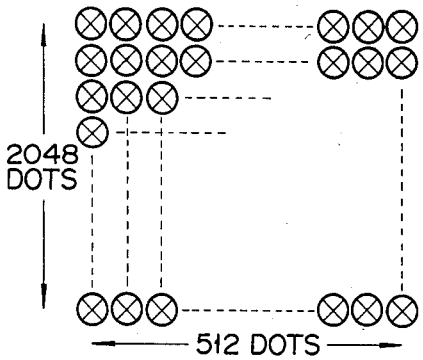
FIG. 15
| STATUS | D | XO | YO | SXe | SYe | SXo | SYo | S |
|---|---|---|---|---|---|---|---|---|
| 1 | 0 | 0 | 0 | 0 | 0 | 0 | 0 | 0 |
| 2 | 0 | 0 | 1 | 0 | 0 | 0 | 0 | 1 |
| 3 | 0 | 1 | 0 | 1 | 0 | 0 | 0 | 1 |
| 4 | 0 | 1 | 1 | 0 | 0 | 1 | 0 | 0 |
| 5 | 1 | 0 | 0 | 0 | 0 | 0 | 1 | 0 |
| 6 | 1 | 0 | 1 | 0 | 1 | 0 | 0 | 1 |
| 7 | 1 | 1 | 0 | 0 | 1 | 0 | 0 | 1 |
| 8 | 1 | 1 | 1 | 0 | 0 | 0 | 1 | 0 |

IMAGE DISPLAY CONTROL APPARATUS

This application is a continuation of application Ser. No. 508,039, filed June 27, 1983, now abandoned.

BACKGROUND OF THE INVENTION

The present invention relates to an image control display apparatus which can simply and effectively edit the stored image data into desired display formats.

For displaying a document prepared by a document writer or a word processing machine on a display screen, after the prepared document data is written into an image memory, the stored document data is read out and then seen as a document on the screen. A common practice is to store the image data in an image memory with a capacity for storing image data almost equal to that of the image data displayed on the full area of the display screen of the display unit. For changing the document currently being displayed, the image data in the image memory must be rewritten every time such a document is changed. Also when two different documents, for example, are simultaneously displayed, it is necessary that the image data of the corresponding documents be edited and written into a single image memory. As described above, the conventional apparatus must rewrite the contents of the image memory every time the display contents are changed. This procedural operation is troublesome.

A conceivable countermeasure taken for this problem is to store beforehand in a plurality of the image memories some different document data to be displayed. In this countermeasure, when the display on the screen is to be changed, all an operator has to do is to access the image memory which stores the document data to be displayed. Further, by simultaneously reading out two or more document data and editing them in a data processor, two or more documents can readily be displayed on the same display screen.

Such a countermeasure, of using a plurality of the image memories, however, suffers from an increase in hardware in the image display control apparatus. This results in a complicated construction of the image display control apparatus and the increased manufacturing cost. Because of these problems, the conventional apparatus is impractical.

SUMMARY OF THE INVENTION

Accordingly, an object of the present invention is to provide an image display control apparatus which is simple in construction and inexpensive, and can readily and effectively perform editing of the display images in such a way, for example, that a document displayed on the display screen can be changed at will without rewriting the contents of the image memory or a part of the document may be replaced by another document.

To achieve the above object, there is provided an image display control apparatus comprising a display unit, an image memory capable of storing larger picture element data than the number of picture elements on the screen of the display unit, write control means for writing a plurality of groups of picture element data into a plurality of memory locations of the image memory, a mapping memory for storing address data for specifying the memory locations for the groups of picture element data in the image memory, in order to correspondingly display the picture element data groups on a plurality of display segments in the screen of the display unit, means for reading out the address data from the mapping memory in the display order of the display unit, and means for reading out from the image memory the picture element data group specified by the address data read out, and for supplying the picture element data read out to the display unit.

BRIEF DESCRIPTION OF THE DRAWINGS

FIG. 5 shows a block diagram of another embodiment of the present invention;

FIG. 6 schematically illustrates the operation of the apparatus of FIG. 5;

FIG. 7 shows a format of the stored data in the mapping memory;

FIGS. 14A through 14C schematically illustrate the picture element data in the memory;

FIG. 15 tabulates input/output data to and from the control device of FIG. 11.

DETAILED DESCRIPTION OF THE PREFERRED EMBODIMENTS

Figure 1:
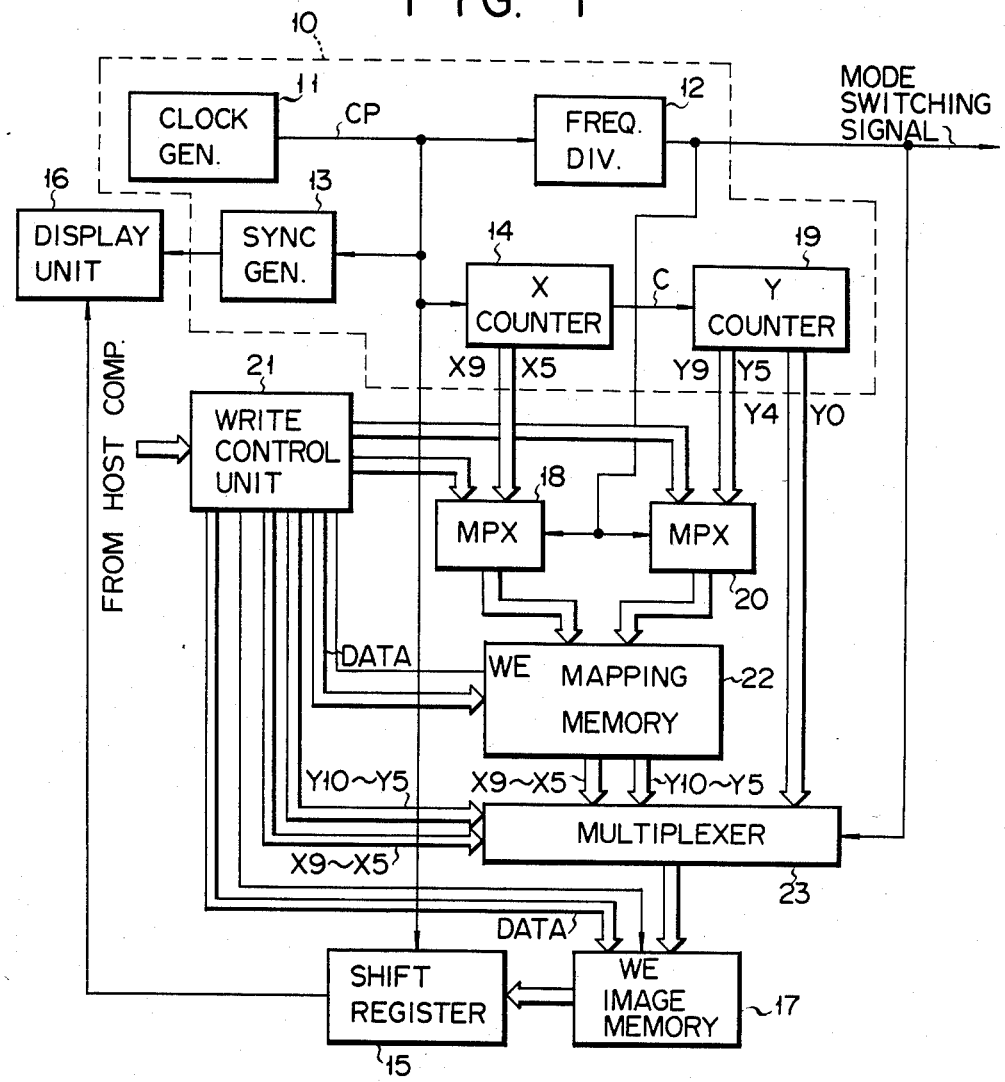
FIG. 1 is a block diagram of an image display control apparatus according to an embodiment of the invention.
Figure 2:
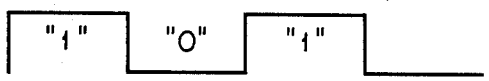
FIG. 2 shows a time chart useful in explaining the operation of the apparatus of FIG. 1.

An embodiment of the present invention will be described referring to the accompanying drawings. In FIG. 1, a clock generator 11 generates clock pulses at 30 n sec period, for example. The clock pulses generated are frequency-divided by a frequency divider 12 by a factor of 32. The frequency divider 12 produces an operation mode select signal at 960 n sec period. The operation mode select signal, as shown in FIG. 2, alternately repeats a "1" period and a "0" period, both the periods being equal to each other in this embodiment. The "1" period indicates a display mode and the "0" period a write mode for the data write to the memory.

The clock pulse of 30 n sec is further supplied to a sync signal generator 13, an X counter 14, and a shift register 15. The sync signal generator 13 is designed to form vertical and horizontal sync signals for a CRT of a display unit 16, using the applied clock pulses. The display unit 16 is driven by the clock pulse from the shift register 15 and displays serial picture element data on the display screen, as it comes in, in the form of a given image of a document. The shift register 15 converts the form of the document data from parallel to serial, and supplies the serial data to the display unit 16. The clock pulse from the clock generator 11 is counted by the X counter 14. The X counter 14 is composed of 10 bits (X0–X9) for securing the flyback period of the CRT. Of these 10 bits, the upper five bits (X5–X9) are coupled with a multiplexer 18. A carry from the X counter 14 is supplied to a Y counter 19. The clock generator 11, frequency divider 12, sync signal generator 13, X counter 14 and Y counter 19 constitute a display control unit 10. The Y counter 19 is composed of 10 bits (Y0–Y9), of which the upper 5 bits (Y5–Y9) are connected to another multiplexer 20. A pair of writing address data is also supplied from the write control unit 21 to the multiplexers 18 and 20. The operation mode of these multiplexers 18, 20 is set up by a mode select signal of 960 n sec derived from the frequency divider 12.

The output signals of the multiplexers 18 and 20 are supplied as the address data to a mapping memory 22. Different address data X5–X9 and Y5–Y10 are read out from the mapping memory 22 and supplied to the multiplexer 23 in a display mode. To the multiplexer 23 are also supplied the lower five bits of data (Y0–Y4) of the Y counter 19 and the mode switching signal. The mapping memory 22 receives a write enable (WE) signal and data derived from the write control unit 21 in a write mode. The multiplexer 23 also receives the mode switching signal from the frequency divider 12 and address signal of 11 bits to be used for writing data in the image memory 17. The output signal of the multiplexer 23 is supplied as an address signal to the image memory 17 for reading out data therefrom. The image memory 17 has a large memory capacity and stores picture element data greater than the number of the picture elements on the screen of the display unit 16. The image memory 17 is also controlled by a write enable signal (WE) from the write control unit 21. DATA being stored in the image memory 17 is supplied from the write control unit 21.

In a display mode, sequential addresses which designate continuous areas of the screen are supplied to the mapping memory 22, so that individual addresses of subimages corresponding to the areas in the image memory 17 are read out. Addresses read out from the mapping memory 22 are supplied to the image memory 17, and the image data is provided to display unit 16 through the shift register 15.

In a write mode, write control unit 21 supplies addresses of the mapping memory 22 and writing data to the mapping memory 22, in case of modifying an image of the screen. Also, changing the image data in the image memory 17 is executed in this mode by the write control unit 21.

Figure 3:
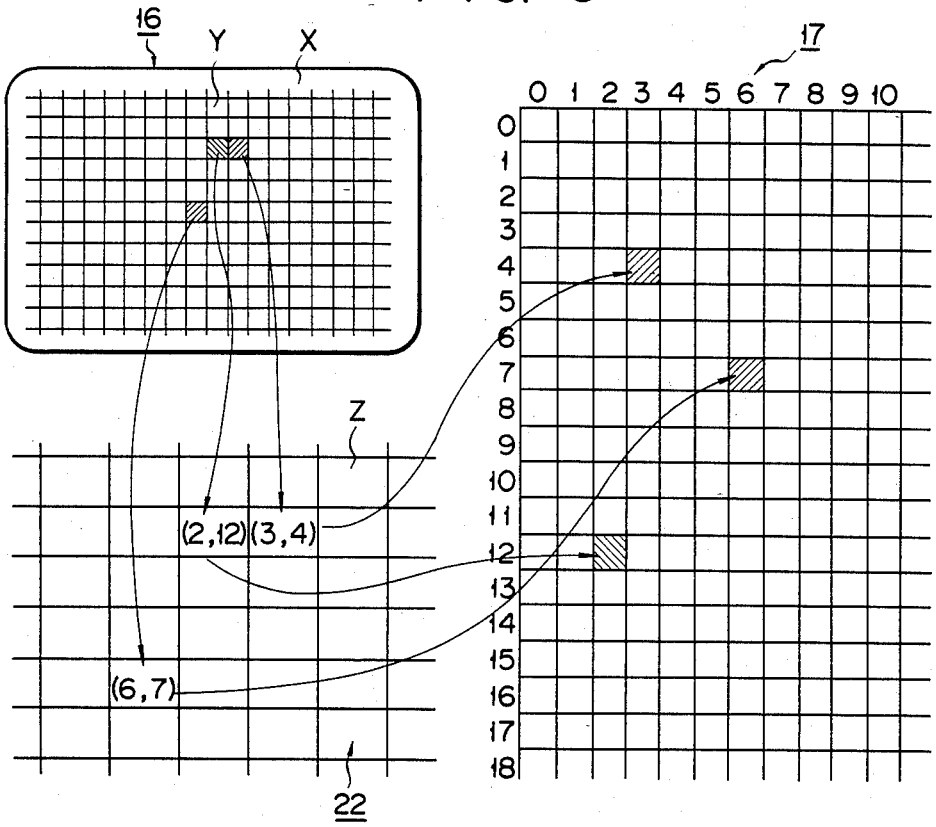
FIG. 3 schematically illustrates positional relationship among display segments on the display screen, memory locations of a mapping memory, and memory locations of an image memory.

As schematically illustrated in FIG. 3, the mapping memory 22 makes a plurality of display segments Y, which are formed by equally dividing the screen area X of the display unit 16, corresponding to the memory locations Z in the mapping memory 22, respectively. At the memory locations Z is stored address data of the image memory 17 in which groups of picture element data to be displayed on the display screen are stored. With this address data, from the specified memory location of the image memory 17 is read out a desired image data for the display segment Y on the screen X. As described above, by using the mapping memory 22 any image data can be displayed in the display segment Y. Also by merely rewriting the address data of the image memory 17 stored in the mapping memory 22, a desired image can be edited and displayed. In other words, the information indicating which image data should be stored in each of the display segments of the display unit 16, is stored in the mapping memory 22, as the address data for the image memory 17 in which the picture element data to be displayed is stored. Because of this feature, the picture image can readily and effectively be edited. In this respect, this embodiment is very useful.

Figure 4:
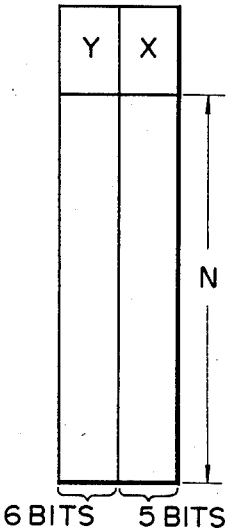
FIG. 4 shows the structure of the mapping memory.

Assume now that the screen area X of the display unit 16 has a size of 1,024 dots×1,024 dots, and that each of the display segments Y contained in the screen area X has a size of 32 dots×32 dots. The number N of the display segments Y contained in the screen X are given by $N=32\times32=1{,}024$. Therefore, 1,024 segments are contained. These display segments $N=1{,}024$ are respectively specified by combinations of five bits of the X counter 14 and six bits of the Y counter 19, as shown in FIG. 4. The image memory 17 has a memory capacity of 1,024 bits×2,048 bits. The mapping memory 22 has a memory capacity of $(5+6)\times1{,}024$ bits.

When comparing an access speed of the image memory 17 with an image displaying speed of the display unit 16, the latter is faster than the former. Therefore, it is not practical to read out the data of every picture element from the image memory 17. To this end, it is a common practice to handle the picture elements by gathering several picture elements together as a data unit. This implies that the displayed image must be segmented depending on the data unit for the signal processing. For this reason, in the case of the binary data image, it is desirable that 8 to 32 picture elements of the image data is gathered to form a data unit. This method using the data blocks, however, provides another problem that the editing unit is limited by the size of the data block. The embodiment to follow is designed so as to solve the above problem.

In FIG. 5, like reference symbols are used to designate like or equivalent units in FIG. 1. The mapping memory **22*a* in this embodiment stores the address data of the picture element data groups stored in the image memory 17, the effective picture element information associated with the picture element data, the information of calculating formulae for display, and the like. For displaying an image a in one part of a display segment P and another image b in the remaining part, a block address A of a data area containing the image a in the image memory 17 and a block address B of a data area containing the image b in the image memory 17 are both stored in a memory location of an address p of the mapping memory 22*a***. The address p also stores the information indicating that the effective picture element data Aa and Ba in the block addresses A and B are contained in one part and the remaining part of the display segment P and the information for selecting and composing only the effective picture element data Aa and Bb.

Of those pieces of the information relating to an address p read out from the mapping memory **22*a*, the block addresses A and B are selected under control of the display control unit 30 through the multiplexer 23, and are supplied to the image memory 17. The display control unit 30 is composed of units included in the display control unit 10 as shown in FIG. 1**.

Upon application of the block addresses A and B, the block address A in the image memory 17 is accessed and the image data is read out from the memory location of the memory address A. Then, the image data in the block address B is read out. The image data read out in this way is stored in registers 31 and 32 which are controlled by a gate circuit 33. The gate circuit 33 has been applied with a latch signal responsive to the operation of the multiplexer 23. This latch signal is selectively supplied to either the register 31 or the register 32, through the gate circuit 33. As a result, the image data in the block address A read out by the first memory access is stored in the register 31, and the image data in the address B read out by the succeeding memory access is stored in the register 32.

The image data stored in these registers 31 and 32 are supplied to the arithmetic operation unit 34. At this time, the operation executing information stored in the address p of the mapping memory 22*a* is read out and supplied to the arithmetic operation unit 34. As shown in FIG. 6, after the picture element data Aa in the first one part of the block A and the picture element data Bb in the second one part of the block B are selected, the picture element data read out from the two registers 31 and 32 are sent to the shift register 15 where those data are composed, thereby forming a unit block of Aa+Bb. The composed image data is sent to and displayed by the display unit 16 shown in FIG. 5.

As described above, in the embodiment shown in FIG. 5, a plurality of data blocks containing the image data to be edited are accessed by the mapping memory. Accordingly, a proper image edition, for example, an interchange of parts of the image data in the display segment, is possible. In this case, the image processing can simply and effectively be performed irrespective of the positions of the blocks delineated. Therefore, the advantages brought about by this embodiment are extremely useful. Useful technical effects attained by this embodiment are also great.

It is sufficient that in this embodiment the number of addresses in the mapping memory and a memory capacity of each address are determined depending on the number of display segments on the display screen, display control modes, and the like. It is within the scope of the invention that, by making an access to three or more data blocks, the image editing is performed of those data blocks. In this case, the image processing can readily be done by properly setting the size of the screen of the display unit.

FIG. 7 shows a data structure of the mapping memory 22*a*. In the structure, AD1 designates an address of a first segment data to be stored in the first register 31 in FIG. 6, and AD2 an address of a second segment data read out into the register 32. Further, MSK1 is data for designating the positions of start and end bits for the non-use parts in relation to the effective part Aa in the format of the first segment data, as shown in FIG. 6. MSK2 is data for designating the positions of start and end bits for the non-use part in relation to the effective part of the second segment data. OP designates an operation data for image editing, as already stated. The operation data contains the data for the logic operation such as AND, OR and EX-OR logic operations. It is noted that the image data of documents, for example, which is displayed by using the mapping memory according to this embodiment, contains not only sentences but also graphs and figures. In this case, it is necessary to rotate characters displayed along the ordinate of the graph by 90°, for example, to enhance the legibility of those characters. For such rotation, conventional apparatus have employed a hardware circuit specially designed for the rotation or through a vertical-horizontal conversion processing of the picture element data with the aid of a computer. Such a scheme of the conventional apparatus makes the construction complicated and takes a long time for the data to be processed. The conventional apparatus presents particular problems when trying to efficiently prepare documents through a man-machine conversation fashion.

The explanation to follow relates to an arrangement of the image memory used in the embodiment of FIG. 1 or FIG. 5, which satisfies the above requirements. The arrangement of the image memory allows easy access to the picture element data in the horizontal or vertical direction. With the control of the access direction, the memory device itself can perform the vertical-horizontal conversion of the picture element data. Further, the n picture element data stored while it is n divided can be simultaneously accessed, so that the access is performed at high and equal speed for both the vertical and horizontal access directions. As described above, this embodiment does not need the specially designed hardware and is operable with less load to the computer. These practical effects are useful.

Figure 8:
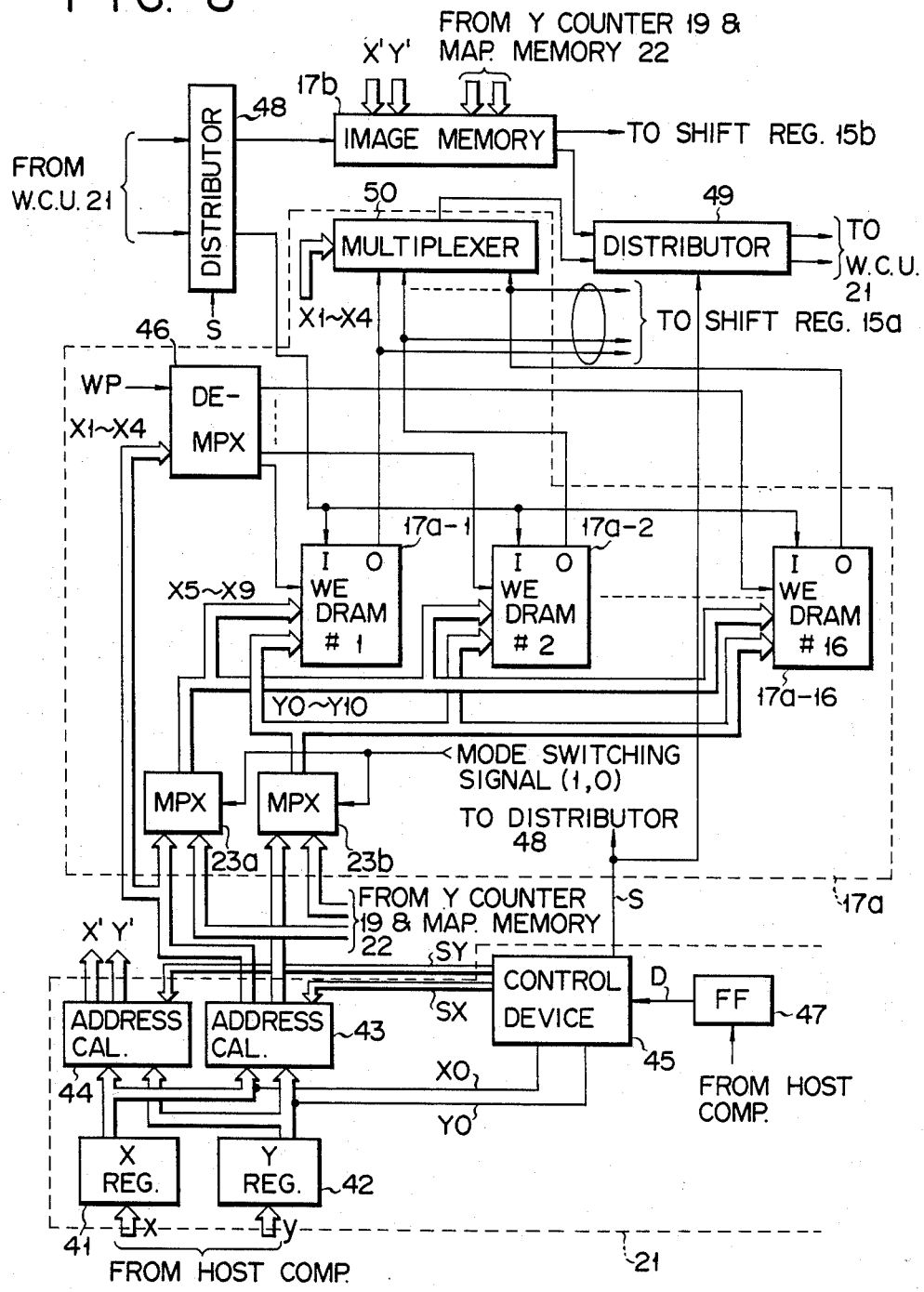
FIG. 8 is a block diagram of a modification of the image memory.
Figure 9:
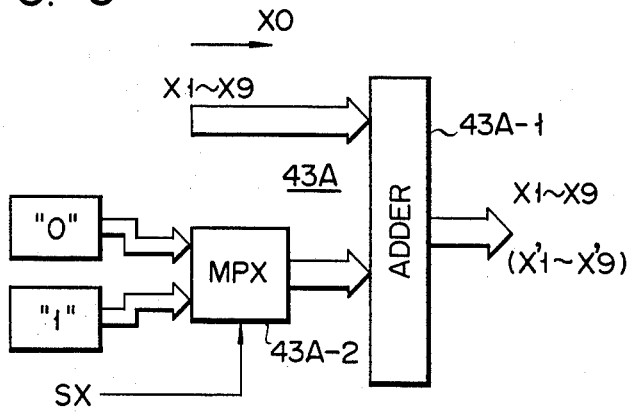
FIGS. 9 and 10 show in block form the address calculators of the memory of FIG. 8.
Figure 10:
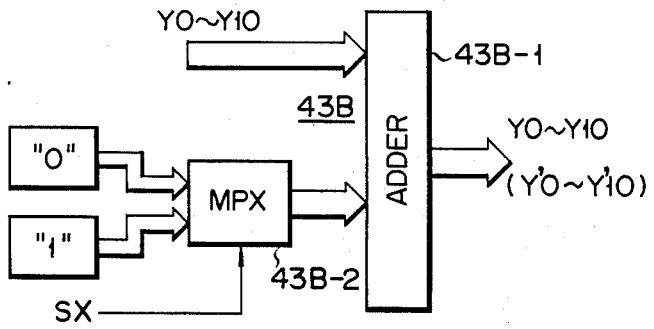

The image data stored in the image memory 17 used in the embodiment of FIG. 1 or FIG. 5 is divided and stored in two image memories 17*a* and 17*b* in an embodiment of FIG. 8. The image memory 17*a* is comprised of 16 dynamic random access memories (DRAMs #1–#16) 17*a* - 1 to 17*a* - 16. These DRAMs 17*a* - 1 to 17*a* - 16 each have a memory capacity of 64 K×1 bits, for example. The other image memory 17*b* has substantially the same arrangement as that of the image memory 17*a*. An X register 41 and a Y register 42, which store the picture element data (x, y) as applied from the host computer (not shown) through the write control unit 21, apply the access address data to address calculators 43 and 44. One calculator 43 has two sections 43A and 43B as shown in FIGS. 9 and 10, respectively. Of the address data X0–X9 supplied from the X register 41 shown in FIG. 9, the data X1–X9 are applied to one of the input terminals of an adder 43A - 1 in the X address calculation section 43A. A "1" or "0" signal, together with a signal SX, is applied to a multiplexer 43A - 2. The signal SX is produced from a control device 45. The output of the multiplexer 43A - 2 is applied to the other input terminal of the adder 43A - 1. The address data X1–X9 are produced from the adder 43A - 1 as the output of the X address calculator 43A. The data X0 from the X register 41 is supplied to the control device 45. Of those address data X1–X9, the lower order data X1–X4 are supplied to a demultiplexer 46 and the multiplexer 23*a*.

In the Y address calculation section 43B of FIG. 10, all the address data Y0–Y10 supplied from the Y register 42 are input to an adder 43B - 1. A "0" or "1" signal SX from the control device 45 is supplied to a multiplexer 43B - 2. The output of the multiplexer 43B - 2 is also supplied to the adder 43B -1. The output signal from the adder 43B - 1 is also applied to the image memory 17*a*. The other address calculator 44 also has two sections, X' and Y' address calculation sections for obtaining address data X'1~X'9 and Y'O~Y'10 of the image memory 17*b*.

The address data from the mapping memory 22 and the data from the Y counter 19 shown in FIG. 1 are also applied to the two multiplexers 23*a* and 23*b*. These multiplexers 23*a*, 23*b* are switched between a read mode or a write mode. In response to the "0" mode signal from the frequency divider 12 of FIG. 1, these multiplexers 23*a*, 23*b* are set in a write mode. In response to a "1" mode signal, the multiplexers 23*a*, 23*b* are set in a read mode or a display mode.

Figure 11:
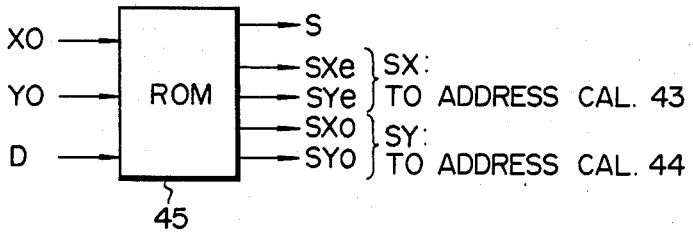
FIG. 11 shows an arrangement of a control device used in the memory of FIG. 8.

The control device 45 receives the access direction data D of "1" or "0" derived from a flip-flop 47 to operate and is arranged as shown in FIG. 11, for example. In FIG. 11, the control device 45 formed of a ROM, is accessed by the access direction data D supplied from a host computer (not shown) and the address data X0 and Y0, and produces a signal S and data SXe, SYe, SXo and SYo which are sent to the address calculators 43 and 44. The signal S is supplied as a control signal to data distributors 48 and 49 (to be described later) for replacing the picture elements. These circuit elements 41 to 45 and 47 constitute a part of the write control unit 21 of FIG. 1.

The two sets of the address data X5–X9 and Y0–Y10 thus obtained are supplied as address data to the DRAMs 17*a* - 1 to 17*a* - 16. In the write mode, the demultiplexer 46 having been supplied with the address data X1–X4, supplies a write enable signal to a write enable terminal WE of the DRAM when it receives a write pulse WP.

The input picture element data is supplied from the write control unit 21 to the distributor 48. In response to the select signal S from the control device 45, the distributor 48 selectively supplies the input picture element data to data input terminals I of the DRAMs 17*a* - 1 to 17*a* - 16 or the input terminal of the image memory 17*b* which has a similar construction.

The picture element data read out from the image memory 17*a* is supplied from the output terminals of the DRAMs 17*a* - 1 to 17*a* - 16 to a multiplexer 50 together with the bit data X1 to X4 from the address calculator 43. The multiplexer 50 supplies the picture element data to one of the input terminals of the distributor 49, the output data of which is also supplied to the write control unit 21. The image memory 17*b* is also provided with an output multiplexer from which the picture element data is supplied to the other input terminal of the distributor 49. The distributors 48 and 49 are used as picture element input circuits operated by the select signal S.

Figure 12:
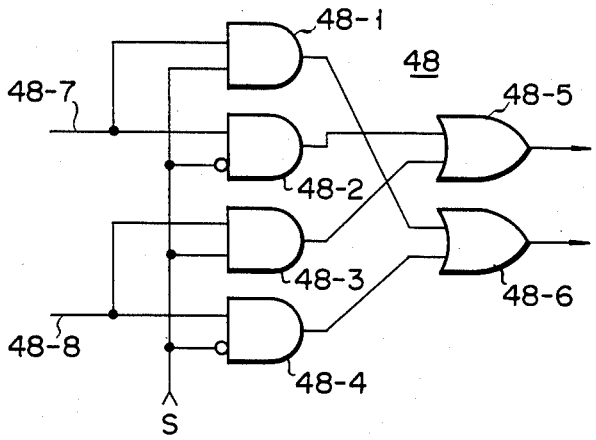
FIG. 12 is a block diagram of a picture element replacing circuit.

FIG. 12 shows an example of the arrangement of the distributor 48. The distributor 48 is comprised of four AND gates 48 - 1 to 48 - 4 and two OR gates 48 - 5 and 48 - 6. The picture element data supplied to an input line 48 - 7 which is one of the input lines of the distributor 48, is coupled with the noninverted input terminals of the AND gates 48 - 1 and 48 - 2. The select signal S is supplied to the other noninverted and inverted input terminals of the these gates 48 - 1 and 48 - 2. Similarly, the other input line 48 - 8 is coupled with noninverted input terminals of the AND gates 48 - 3 and 48 - 4. The select signal S is applied to the other noninverted input terminal and inverted input terminal of the AND gates 48 - 3 and 48 - 4.

In the arrangement of FIG. 12, when the select signal S is "1", the AND gates 48 - 1 and 48 - 3 are enabled and the picture element data on the line 48 - 7 is produced from the OR gate 48 - 6. The picture element data on the line 48 - 8 is produced from the OR gate 48 - 5. In this way, the picture element data are interchanged or replaced with each other. When the signal S is "0", the AND gates 48 - 2 and 48 - 4 are enabled and the interchange of the picture element data supplied on the lines 48 - 7, 48 - 8 is not performed.

Figure 13:
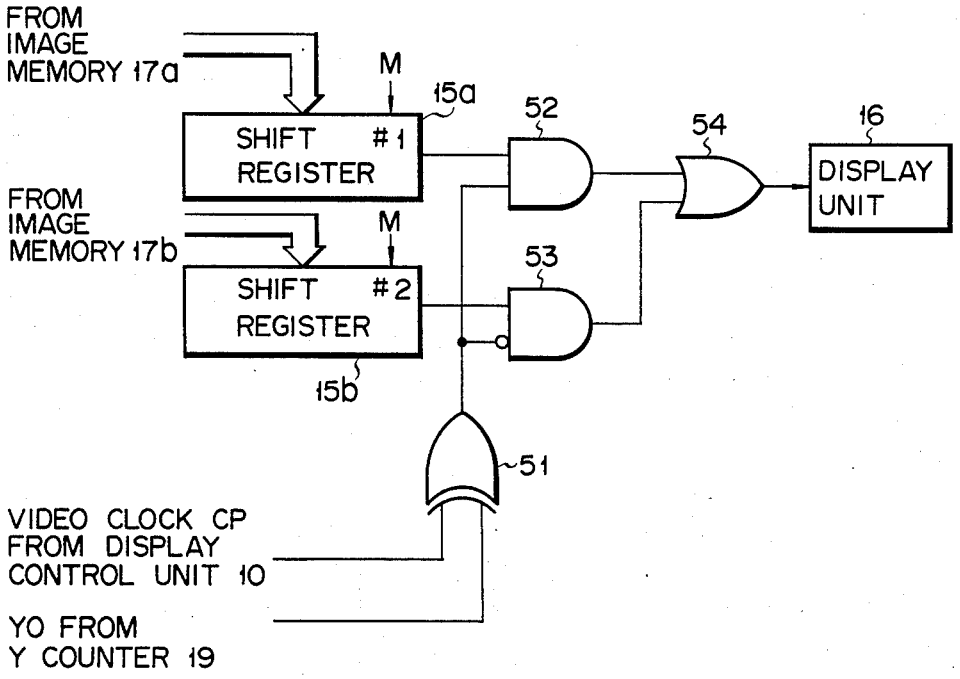
FIG. 13 is a block diagram of a shift register.

The output picture element data from the image memories 17*a* and 17*b* are stored in the shift registers 15*a* and 15*b* shown in FIG. 13, respectively. The output picture element data are supplied from these registers 15*a*, 15*b* to the display unit 16 shown in FIG. 1. The data Y0 and the video clock signal CP from the display control unit 10 are supplied to an exclusive-OR gate 51. The output of the gate 51 is then applied to one of the noninverted input terminals of the AND gate 52 and an inverted input terminal of an AND gate 53. The output picture element data of the shift registers 15*a* and 15*b* are supplied to the other noninverted input terminals of the AND gates 52 and 53, respectively. The output signals from these AND gates 52 and 53 are supplied to an OR gate 54 and then to the display unit 16.

In the image display control apparatus thus arranged, the first and second image memories 17*a* and 17*b* store the display picture element data in such a way that the picture element data are divided into n data blocks arranged in a staggered fashion. In this embodiment, n=2. As shown in FIG. 14, a display image is formed of an array of 1,024 horizontal dots and 2,048 vertical dots, and is composed of two types of dots, represented by ○ and ⊗. The ○ dots or even dots are stored in the image memory 17*a* of FIG. 14B and the ⊗ dots or odd dots in the image memory 17*b* of FIG. 14C. Specifically, the picture element data at the locations on the 0th row/0th column and the 0th row/1st column are stored in the addresses of the 0th row/0th column in the memories 17*a* and 17*b*, respectively. The picture element data at the locations on the 0th row/2nd column and the 0th row/3rd column are stored in the addresses on the 0th row/1st column in the memories 17*a* and 17*b*, respectively. On the next row line, the picture element data at the locations on the 1st row/0th column and the 1st row/1st column are interchanged in the positional order and stored in the corresponding addresses of the memories 17*a* and 17*b*, respectively. For writing the picture element data in a staggered arrangement, the horizontal access mode is set at the flip-flop 47. In this state, a write address (x, y) is applied to the registers 41 and 42. The data of the least significant bits X0 and Y0 of the address (x, y) are transferred to the control device 45 which in turn judges whether the row and column of this address belong to the even row and column or the odd row and column in the dot matrix array. As a result, the select signal S for interchanging the picture elements is applied to the distributors 48 and 49.

The control statuses of the control device 45 in reading and writing the staggered picture element data are defined as shown in TABLE 1 and the relationship between the input and output of the control device 45 of FIG. 11 are as shown in FIG. 15.

TABLE 1

| Control status | Access direction | Horizontal address x | vertical address y | Access addtess of the first image memory | Access address of the second image memory | Dot interchange |
|---|---|---|---|---|---|---|
| 1 | Horizontal | Even column | Even row | $512 \times y + \left[\frac{x}{2}\right]$ | $512 \times y + \left[\frac{x}{2}\right]$ | Non |
| 2 | Horizontal | Even column | Odd row | $512 \times y + \left[\frac{x}{2}\right]$ | $512 \times y + \left[\frac{x}{2}\right]$ | Present |

TABLE 1-continued

| Control status | Access direction | Horizontal address x | vertical address y | Access addtess of the first image memory | Access address of the second image memory | Dot interchange |
|---|---|---|---|---|---|---|
| 3 | Horizontal | Odd column | Even row | $512 \times y + \left[\frac{x}{2}\right] + 1$ | $512 \times y + \left[\frac{x}{2}\right]$ | Present |
| 4 | Horizontal | Odd column | Odd row | $512 \times y + \left[\frac{x}{2}\right]$ | $512 \times y + \left[\frac{x}{2}\right] + 1$ | Non |
| 5 | Vertical | Even column | Even row | $512 \times y + \left[\frac{x}{2}\right]$ | $512 \times y + \left[\frac{x}{2}\right] + 512$ | Non |
| 6 | Vertical | Even column | Odd row | $512 \times y + \left[\frac{x}{2}\right] + 512$ | $512 \times y + \left[\frac{x}{2}\right]$ | Present |
| 7 | Vertical | Odd column | Even row | $512 \times y + \left[\frac{x}{2}\right] + 512$ | $512 \times y + \left[\frac{x}{2}\right]$ | Present |
| 8 | Vertical | Odd column | Odd row | $512 \times y + \left[\frac{x}{2}\right]$ | $512 \times y + \left[\frac{x}{2}\right] + 512$ | Non |

In the table, [x/2] indicates an integer part of x/2.

As shown in TABLE 1, the control device 45 controls the access address of the picture element data of 2 dots for the 1st and 2nd memories 17*a* and 17*b*, depending on the access direction of the picture element data and the access picture element locations. The control device 45 further controls the interchange or replacement of the picture elements and executes the read and write operations of the picture element data for every 2-dot data unit.

For writing the picture element data on the 0th row, the control device 45 is set in a control status (1), and the 2-dot picture element data are written into the memories 17*a* and 17*b* in sequential manner. For writing the picture element data on the next row, a control status (2) is set up in the control device 45. In this writing operation, the picture element data are interchanged every 2-dot data unit in their positional order and written into the memories 17*a* and 17*b* in successive manner. This process is successively performed on the picture element data on the even and odd rows. And the picture element data of the entire image are staggered and loaded into the memories 17*a* and 17*b*.

Figure 16:
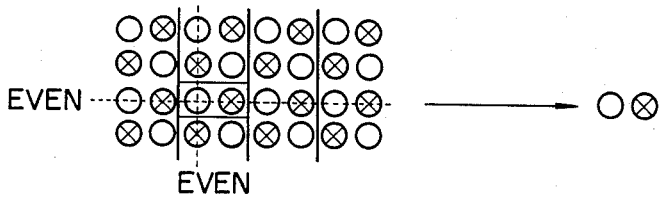
FIGS. 16 through 19 schematically illustrate the operation of the modification of FIG. 8.

How to read out every 2-dot data unit the picture element data stored as shown in FIGS. 14B and 14C in the horizontal direction will be explained. An example of when the 2-dot picture element data is read out from the picture elements on the even rows and odd columns will be used. The data of the first dot is stored in the image memory 17*a*. The data of the second dot is stored in the memory 17*b*. The corresponding address of the memories 17*a* and 17*b* are simultaneously accessed to read out the data, as shown in FIG. 16. That is to say, these memories 17*a*, 17*b* are accessed under the control status (1). To read out the 2-dot picture element data from the picture elements on the odd row and the even column, all a designer has to do is to design the circuit such that the corresponding addresses in the memories 17*a* and 17*b* are simultaneously accessed under the control of the control status (2) and the picture element data read out are interchanged in their places and then output.

Figure 17:
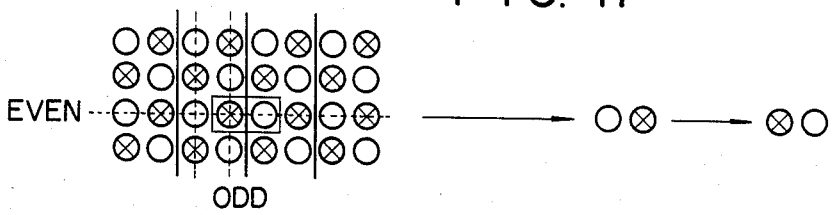

Let us consider a case that the two-dot picture element data are readout from the staggered picture element data on the even row and the odd column. In this case, the first dot and the second dot of the picture element data to be selected belong to the different or adjacent blocks in the staggered picture element data. To cope with this, the access address of the image memory 17*a* is incremented according to a control status (3), to read out the picture element data, as shown in FIG. 17. The 2-dot picture element data thus read out are arranged in an order reversed to the original one. Therefore, these dots are output after being interchanged. For taking out the 2-dot picture element data from the staggered picture element data on the odd row and the even column, the access address for the image memory 17*b* for reading out the picture element data is incremented. In this case, no interchange of the 2-dot picture element data is required.

In making access to the picture element data in the vertical direction, it is sufficient that the access addresses for the memories 17*a* and 17*b* are different in the vertical direction, irrespective of the operation statuses of reading and writing. The 2-dot picture element data successively arranged in the vertical direction are also stored in the memories 17*a* and 17*b*, while being arranged in a staggered fashion. The simultaneous access to those picture element data is merely required. This is effected according to control statuses (5) to (8). In this case, by shifting the access address for the memories 17*a* and 17*b* one from another by one row, the picture element data of two dots continuously arranged in the vertical direction can simultaneously be accessed. It is evident that the picture elements are replaced with each other depending on the specified addresses.

Figure 18:
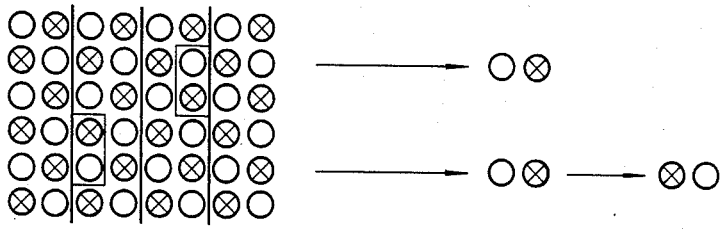
Figure 19:
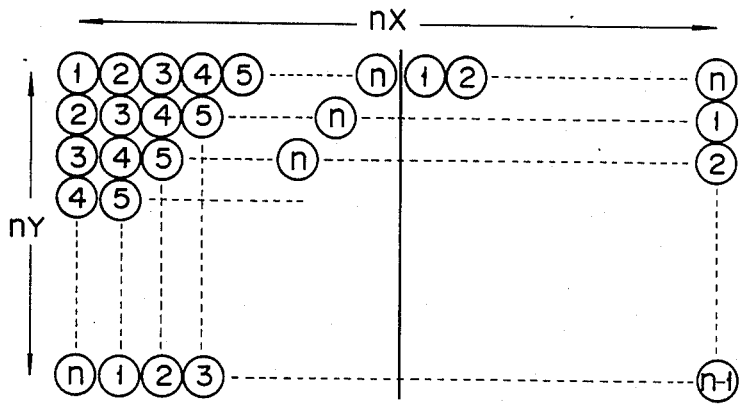

According to the memory apparatus as shown in FIG. 8, the desired picture element data can readily be read out under the access control by the memories 17*a* and 17*b*, as illustrated in FIGS. 16 to 18 in which the access picture element data are enclosed by rectangular frames. Additionally, with one time access, two continous picture element data can be acessed simultaneously. The access times between the horizontal access and the vertical access are equal to each other.

Thus, the vertical-horizontal replacement can easily be realized such that the memories 17*a* and 17*b* are accessed in the vertical direction to read out the picture element data, and the read out picture element data is supplied through the shift registers 15*a* and 15*b* to the display unit 16 which horizontally scans the picture elements for the image display. In this case, no specially designed hardware is required. Further, since access time is short, when the image display control apparatus according to this invention is assembled into a word processing machine for interfacing with people great effects can be attained. This feature of easy access to the image memory in the vertical direction is very useful.

Whereas in the above-mentioned embodiment the memory is accessed for each data unit of two dots, the same can be done for each data unit of n dots. In this case, n image memories are used and the picture element data is arranged in a staggered fashion where the picture elements are divided into n blcoks. The switching of the access addresses and the interchange of the picture elements are executed at the boundary delineating the data blocks. Accordingly, in this case, it is necessary that in the horizontal access status, the access address is selected according to $(X \cdot y+[x/2])$, $(X \cdot y+[x/n]+1)$ and in the vertical access status the value m $(m=1, 2, \ldots, n-1)$ in the access address of $(X \cdot y+[x/n]+n \cdot x)$ is selected. Further, the number of the picture elements of the image to be processed may be freely selected.

What is claimed is:

1. An image display control apparatus comprising;

a display unit;

an image memory having a picture element data storing capacity larger than the total number of picture elements on the screen of said display unit;

write control means for writing a plurality of units of data into a plurality of memory locations of said image memory, each unit of data including at least two picture element data;

a mapping memory for storing only address data for specifying the memory locations for the units of data in said image memory in order to correspondingly display the units of data on a plurality of display segments in the screen of said display unit;

first means for reading out the address data from said mapping memory in a display order of said display unit; and second means for reading out from said image memory the units of data specified by the address data read out by the first reading means, and for supplying the read-out units of data to said display unit.

2. An image display control apparatus according to claim 1, wherein said first means for reading out includes means for reading out a plurality of address data from said mapping memory, and said second means for reading out includes means for reading out the plurality of units of picture elements data from said image memory, using the plurality of the read out address data.

3. An image display control apparatus according to claim 2, wherein at the memory locations of said mapping memory are stored the plurality of address data and arithmetic operation data for editing the plurality of picture element data designated by the address data, and said means for supplying the picture element data to said display unit includes means for editing the units of plurality of picture element data on the basis of the arithmetic operation data read out from said mapping memory.

4. A image display control apparatus according to claim 3, wherein said editing means includes a plurality of registers for storing the plurality of picture element data units read out of said image memory, a logic operation unit for executing an operation on the plurality of picture element data units supplied from said registers by using said arithmetic operation data, to thereby compose picture element data blocks, and a shift register for storing the output from said arithmetic operation unit.

5. An image display control apparatus according to claim 3, wherein the arithmetic operation data stored in the memory locations of said mapping memory contains masking data including start and end bits to designate a part of each of the picture element data units not to be displayed.

6. An image display control apparatus comprising:

a display unit;

an image memory including n image memory units for storing display image data of $(n \times X)$ columns and Y rows having $(n \times X \times Y)$ picture elements data with $(n \times X)$ picture elements arranged in a horizontal direction and Y picture elements arranged in a vertical direction, each memory unit having a picture element data storing capacity of X in the horizontal direction and Y in the vertical direction;

means for distributing said $(n \times X \times Y)$ picture elements data to said n image memory units in such a manner that the units of n picture elements data in a first row are sequentially distributed to the image memory units and the units of n picture elements data in a second row adjacent to said first row shifted by one picture element data from those of said first row is sequentially distributed to the n image memory units;

a mapping memory for storing only address data for specifying memory locations for the units of n picture elements data in said image memory units in order to correspondingly display the units of data on a plurality of display segments on a screen of said display unit;

means for generating access direction designating data for designating an access direction of the picture element data stored in said n image memory units;

first means for simultaneously accessing said n image memory units for reading out the picture elements data successively in the horizontal direction according to the access direction designating data; and second means for simultaneously accessing said n image memory units for reading out the picture elements data successively in the vertical direction according to the access direction designating data.

7. An image display control apparatus according to claim 6, wherein said first simultaneous accessing means includes control mens for selecting said access direction designating data on the basis of the locations of the picture element data in one of the n image memory units.

8. An image display control apparatus according to claim 6, wherein said distributing means includes picture element interchange means for interchanging the picture element data in their arranged order on the basis of the picture element locations in one of the n image memory units.

9. An image display control apparatus according to claim 6, wherein said image memory includes two image memory units, and said distributing means includes a flip-flop circuit for alternately generating first and second outputs which alternately designate the two image memory units.

* * * * *